United States Patent [19]

Rossitto et al.

[11] 4,069,532

[45] Jan. 24, 1978

[54] METHODS FOR STIFFENING PORTIONS OF FLEXIBLE MATERIAL

[75] Inventors: Conrad Rossitto, Andover; Robert Pierce Follett, Pepperell, both of Mass.

[73] Assignee: USM Corporation, Boston, Mass.

[21] Appl. No.: 719,992

[22] Filed: Sept. 2, 1976

[51] Int. Cl.[2] ..... A43D 00/00; B29B 00/00

[52] U.S. Cl. ..... 12/146 D; 156/245

[58] Field of Search ..... 12/146 D, 146 R, 142 R, 12/51, 52; 425/117; 156/245, 500, 498

[56] References Cited

U.S. PATENT DOCUMENTS

| | | | |
|---|---|---|---|
| 3,442,743 | 5/1966 | Schultz et al. | 156/245 |
| 3,795,466 | 3/1974 | Capuano | 425/117 |
| 3,945,074 | 3/1976 | Babson et al. | 12/52 |

*Primary Examiner*—Patrick D. Lawson

*Attorney, Agent, or Firm*—Benjamin C. Pollard; Richard B. Megley; Vincent A. White

[57] ABSTRACT

The method for stiffening a flexible workpiece such as the toe portion of a shoe in which a layer of fast crystallizing linear synthetic polymer resin is deposited in molten condition on a transfer surface member which is at a temperature and has a heat take up capability to bring the resin at its surface to a temperature for rapid crystallization of the resin, the resin layer is pressed between the transfer surface member and the surface of the workpiece within a time after deposition of the resin on the transfer surface member during which at least the exposed surface of the resin layer remains molten for wetting adhesive engagement with the surface of the workpiece and the transfer surface member is separated from the resin layer at a time when at least a surface film of crystallized resin has formed adjacent said transfer surface member.

10 Claims, 3 Drawing Figures

METHODS FOR STIFFENING PORTIONS OF FLEXIBLE MATERIAL

FIELD OF THE INVENTION

This invention relates to improvements in methods for stiffening portions of flexible materials, particularly shoe parts.

BACKGROUND OF THE INVENTION

In the stiffening of flexible materials such as shoe parts a method has been developed in which molten synthetic polymeric material is applied to a surface of a part to be stiffened, such as the toe portion of a shoe, in wetting adhesive relation and thereafter is cooled to a stiff resilient condition providing the desired stiffness.

In a modification of that method particularly useful for stiffening of workpieces having surface irregularities and/or openings, the molten resin material is deposited on a chilled transfer surface member and pressed against the surface of the article to be stiffened while the exposed surface of the resin on the transfer surface member is still in condition effective to wet and adhere to the surface of the article to be stiffened. The transfer surface member is refrigerated to bring its temperature well below room temperature, often to 5° C. and hardens the resin adjacent it to enable the transfer surface member to be separated cleanly from the resin which adheres to the workpiece.

While these methods have provided effective stiffening and have gone into extensive commercial use, the stiffener layers formed have not had the strength required for certain types of shoes particularly men's shoes. Efforts have been made to provide greater stiffness through the use of stiffer resins. However, with the modified method, it has been found that the chilled transfer surface members would not strip cleanly from stiffener material deposited on the workpiece but rather that the resin adjacent the transfer surface member would become gummy and rubbery and would adhere to the transfer surface member under the operating conditions required in commercial operation as in shoe factories.

SUMMARY OF THE INVENTION

It is an object of the present invention to provide an improved method effective to provide greater stiffening action using hot melt applied resin stiffening material.

To this end and in accordance with a feature of the present invention, a layer of fast crystallizing synthetic polymer resin is deposited in molten condition on a transfer surface member under conditions controlled to generate a surface film of crystallized resin adjacent the transfer surface member to enable ready separation from the resin layer after application of the layer to the surface of a workpiece to be stiffened.

BRIEF DESCRIPTION OF THE DRAWINGS

The above and other objects and features of the invention will now be described in connection with a preferred embodiment and with reference to the accompanying drawings forming part of the present disclosure in which.

Figure 1:
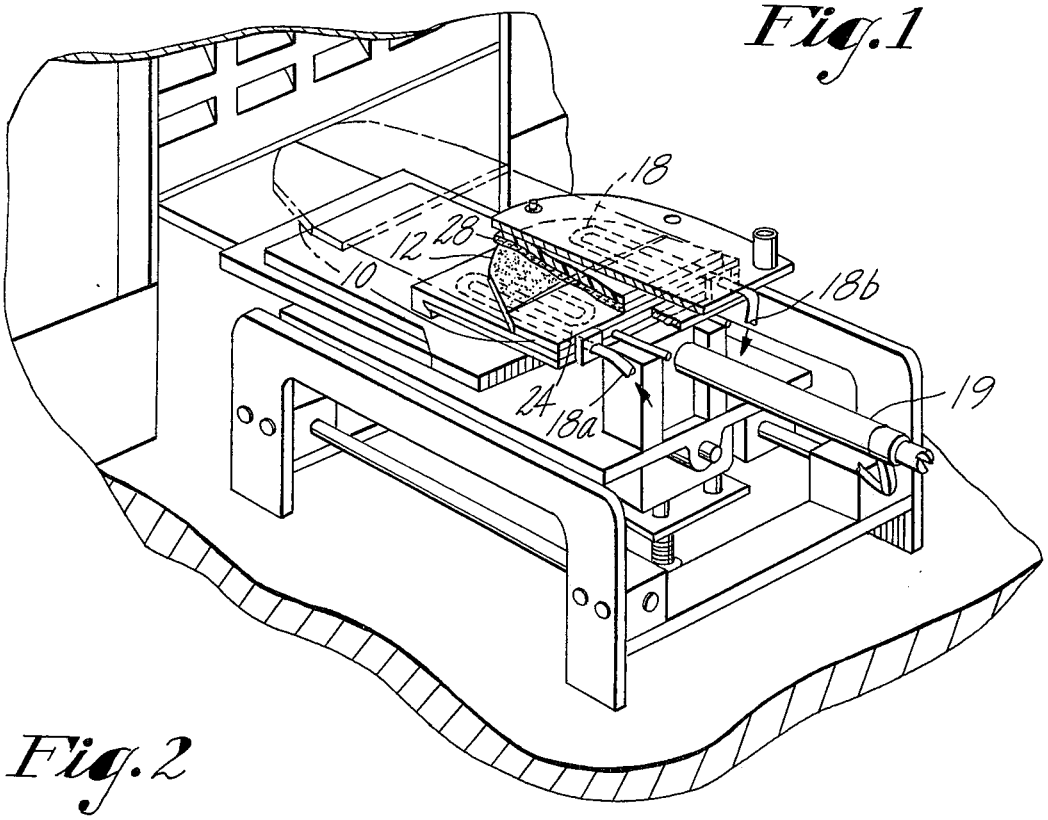
FIG. 1 is an angular view, with parts broken away of a device useful in practicing the method of the present invention.

In accordance with the present invention, a strong resilient stiffener layer such as a box toe is formed on a flexible workpiece to be stiffened by the application in molten condition of a layer of crystallizable and work-orientable linear resin free from side chains under controlled temperature conditions and using procedures effective to secure wetting adhesive engagement of the resin with the workpiece and rapid development of firmness and strength through crystallization of the applied resin.

Crystallization of a resin is the organization of the long chain linear molecules of the resin in which the molecules are packed in a relation providing greater strength and stiffness than is obtainable where the molecules are in random orientation as in amorphous or glassy state. In synthetic polymer resins, the organization is generally accomplished by the association of repeating segments of the polymer in an ordered state in which segments may associate with a parallel relationship between one segment and adjacent segments of the polymer which provides greater strength in the direction of the segments. Formation of a crystallized resin stiffener layer thus gives a strength greater than an uncrystallized resin layer and this improvement in strength of the resin allows stiffening articles such as the toe portions of men's shoes which have been difficult to stiffen satisfactorily by known methods involving hot melt application of stiffener resin.

The development of crystallinity is particularly important with polyester resins or with polyesteramide resins having a high ester content because of their relatively low hydrogen bonding ability in comparison with polyamide resins. That is, the amide groups of polyamide resins provide both a hydrogen and an oxygen so that, even in a glass state resulting from rapid cooling of such resins, the hydrogen bonding forces of the polyamide resins provide substantial strength. On the other hand, polyesters and polyesteramides have only limited hydrogen bonding ability so that the development of strength and stiffness is dependent in large measure on the packing of the molecular chains in an ordered relationship.

Development of crystallinity in the applied molten resin at a rate useful in shoe manufacturing operations, is secured according to the method of the present invention through deposition of a layer of the molten substantially linear polymer resin on the surface of a transfer surface member of which the heat take-up capability is correlated with the physical properties of the resin, the layer of resin is pressed into wetting adhesive engagement with the surface of the article to be stiffened and the transfer surface member is separated from the layer of resin on the article.

The method will be described as it is practiced in the stiffening of a shoe part such as a box toe using the mechanical application apparatus described in U.S. Pat. No. 3,945,074; but it will be understood that the method may be used to stiffen other flexible workpieces and may employ other apparatus or be carried out by hand if desired.

Figure 2:
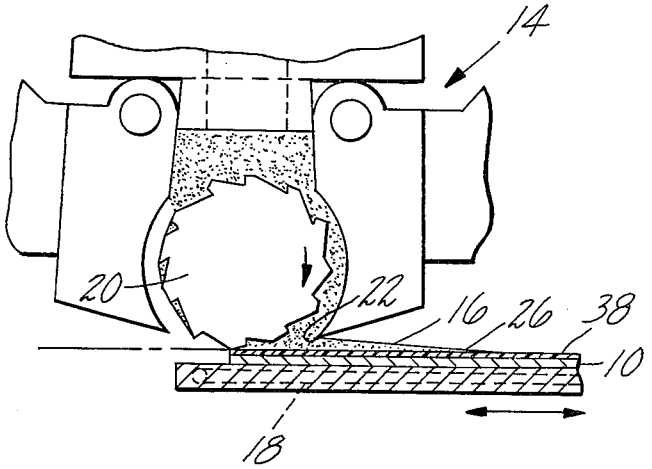
FIG. 2 is a somewhat schematic end view of an applicator device depositing molten resin on a transfer surface member as one step in practicing the method of the present invention.

Referring to FIGS. 1 and 2, a machine useful for practicing the present method includes a transfer surface member or platen 10 having an outline shape corresponding in part to the desired shape of the stiffener, in this case a stiffener for the toe of a shoe. As shown, the shape includes a forward portion 12 of rounded outline corresponding to the rounded outline of the toe portion of a shoe upper. The transfer surface member 10 is relatively movable with respect to a cement applying device 14 for receiving a charge of molten resin as a layer 16 of controlled thickness on its surface. Channels 18 (See FIG. 2) are provided in the transfer surface member 10 for circulation of a temperature control fluid supplied through flexible tubes 18a and 18b. As shown in broken lines, the transfer surface member 10 is mounted for movement by an air piston and cylinder device 19, from its initial position to a charge-receiving position beneath an applicator member such as an applicator roll 20 (See FIG. 2) of a cement applying device 14 such as that disclosed in U.S. Pat. No. 3,277,867 to Kilham et al. During its return to its initial position by the device 19, a resin layer 16 is deposited on the transfer surface member 10 in thickness controlled by the edge 22 of the applicator. The deposited layer 16 will cover areas of the transfer surface member 10 from the forward portion 12, considered relative to the ultimate position of the resin in the toe of a shoe, to a position which will give a resin stiffener of the desired length, leaving a rearward portion 24 of the transfer surface member 10 free of resin. If desired, the resin layer 16 may be tapered by the edge 22 toward its rearward edge 26 to provide a feathered edge.

The toe portion 28 of an upper to be stiffened is positioned (See FIGS. 1 and 3) with its exterior surface against a compressible pad 32 bonded to the surface of plate 34 where the toe portion 28 is clamped by U-shaped member 36 leaving exposed the interior surface on which a stiffener layer 16 is to be applied. The clamping member 36 is moved to and from clamping position by pins 37 which are actuated by suitable drive means (not shown).

With the transfer surface member 10 carrying molten resin in its forward position and the clamped toe portion 28 of the upper in vertical alignment as shown in FIG. 1, the transfer surface member 10 is forced upward by a piston (not shown), to bring the resin into wetting adhesive engagement with the interior surface of the toe portion 28 of the upper left exposed by the U-shaped clamping member 36 which is held against upward movement by suitable means (not shown) so that the resin layer is pressed between the transfer surface member 10 and the toe portion 28 which is resiliently backed by the pad 32. The transfer surface member 10 is held in this relation for a time ("dwell time") for the resin at the transfer surface member to reach a firmness which will enable ready separation of the transfer surface members 10 from the resin layer 16. The pressing action has been found effective to cause limited lateral flow of molten portions of the resin layer 16 and may be used to form thin tapering edge portions by flow from the edge of the resin layer 16 between the surface of the toe portion 28 of the upper and the area 24 of the transfer surface member rearwardly of the area on which the layer 16 of resin was deposited. The pressing action also acts on the resin to accelerate crystallization.

For successful practice of the method it is important (1) that the free surface of the resin layer 16 on the transfer surface member 10 remain molten until it has entered into wetting adhesive engagement with the surface of the upper and (2) that the resin develop physical strength and firmness at its interface with the transfer surface member 10 to enable complete and easy separation of the transfer surface member from the resin layer 16 within the period of four seconds or less demanded by manufacturing economics.

Although, from experience with resin commonly used in this stiffening procedure, it was expected that these conflicting demands could be satisfied to harden resins such as polyester and polyesteramide resins which are stronger and stiffer than the usual polyamide stiffener resins by greater chilling capability of the transfer surface member 10 as by lower temperatures and high heat conductivity of the transfer surface member material, it was found that the greater chilling merely brought these resins to a rubbery stage which would not separate well from the transfer surface.

I have now found that controlled heat take-up capability, for example, through use of higher transfer surface member temperatures than heretofore found useful with commonly used polyamide stiffener resins, is effective physically to develop strength and firmness in the rapid crystallizing resins employed in the present method to enable easy and complete separation of the transfer surface member from resin pressed against the surface of a workpiece to be stiffened and that the higher temperature likewise gives improved maintenance of the molten condition of the exposed surface of the resin up to the time it is pressed against the surface of the workpiece.

Crystallizable resins useful for hot melt application to form stiffener layers in the method of the present invention are linear work-orientable polymers substantially free from side chains and stable and having molecular weights such that when melted, they are readily moldable but not freely flowable and have a viscosity in molten condition at the temperature of application low enough to wet and adhere to an article to be stiffened but sufficiently high that the molten material will sufficiently not penetrate the fine structure of the material to be stiffened. Among such resins are the linear resinous polyesters, copolyesters, polyesteramides, copolyesteramides and copolymers of ethylene such as ethylenevinyl acetate, ethylene-ethylacrylate ethylene-acrylic acid and ethylene-propylene copolymers and mixtures of these. The preferred resinous polymers include ester components derived from reaction of one or more glycols of the series $HO(CH_2)_nOH$ where n is an integer of from 4 to 10, with a dicarboxylic acid component which may be a mixture of a major portion of an aromatic dicarboxylic acid such as terephthalic acid and a substantially saturated aliphatic dicarboxylic acid having from 4 to 36 carbon atoms.

For use in stiffening shoe parts, these resins preferably have crystal melting points of from about 110° to 190° C., crystallization temperatures of from about 80° C. to about 165° C. (these temperatures being determined using a differential scanning calorimeter which shows breaks in the endotherm and exotherm curves), and a melt viscosity of from 20,000 to 100,000 using the Instron Rheometer with a shear rate of 50, or less than 35 seconds as determined at 215° C. with a ⅜ inch steel ball falling through 4 inches of a column of molten material in a 25mm. diameter tube, 150mm. in length. These resins are brought to a temperature above their melting points at which they are at a viscosity for application in the cement applying device 14 and are spread on the transfer surface member 10 as a molten layer 16 which may be from about 0.010 to about 0.050 inch in thickness, preferably from about 0.030 to about 0.040 inch in thickness.

Crystallization rate of resins for use in shoes must be such that when applied as a molten layer 16 on a transfer surface member 10 with heat take-up capability controlled as described above, and thereafter pressed into wetting adhesive engagement with a shoe part, the resin at the surface of the transfer surface member 10 will be sufficiently firm and strong through crystallization for separation from the transfer surface member 10 within the four second acceptable time limit for shoe manufacturing operations.

Temperatures employed for the transfer surface member 10 must of course be below the crystallization temperature of the stiffener resin. However, while lowering the temperature substantially below the crystallization temperature increases the crystallizing forces, it also increases the viscosity of the molten material to resist the movement of resin molecules into alignment for development of crystal structure and when the temperature is sufficiently low, the molecules become unable to move into alignment and crystallization stops.

Determination of the best heat take-up capability of the transfer surface member 10 to give rapid crystallization is in part a matter of balancing these factors; but further factors must be considered. The resin is a relatively poor heat conductor so that the temperature of the resin at its interface with the transfer surface member 10 will be different from the temperature in the body of the layer 16 of molten resin which may be near the temperature at which it was spread on the transfer surface member 10. The temperature of the resin at the interface is the result of heat transfer between the resin at the interface with the body of resin of the molten layer on the one hand and with the transfer surface member on the other hand, and is at a level between the temperature of the applied molten resin and the initial temperature of the transfer surface member. Also, while the main portion of the transfer surface member 10 may be metal which has a high heat conductivity, the ability of the transfer surface member 10 to take up heat from the resin is preferably reduced by the provision at the surface of the transfer surface member of a coating, film or sheet 38 of resinous release material, preferably a resin material providing a release surface such as polytetrafluorethylene or silicone, which markedly reduces the take-up of heat from the molten resin. The temperature and heat take-up capability of the transfer surface member are correlated with the temperature at which the molten resin is applied and with the temperature of crystallization of the resin to ensure that the temperature of the resin at its interface with the surface of the transfer surface member is at a level to give an optimum crystallization rate to develop a strength and firmness of the resin at the interface to enable the earliest separation of the transfer surface member from the resin surface. Also, it is important that the temperature of the transfer surface member be sufficiently high to avoid supercooling of the resin.

It has been found that a metal transfer surface member 10 carrying a release surface layer 38 of polytetrafluorethylene and maintained at a temperature of from about 32° C. to 50° C. will effect crystallization of the preferred resins (crystallization temperatures of 80° C. to 165° C.) at its interface with a molten layer of the preferred resins applied at from about 175° C. to about 220° C. within four seconds to an extent enabling easy separation of the transfer surface member from the resin on the shoe part. Resins having lower crystallization temperatures may use lower transfer surface member temperatures. For example, a resin having a crystallization temperature of 73° C. will separate well from a transfer surface member maintained at 27° C.

After separation of the transfer surface member 10, the resin layer 16 on the shoe part has a smooth exposed surface and a smoothly tapering rear edge which extends beyond the area corresponding to the area of resin carried by the transfer surface member.

Figure 3:
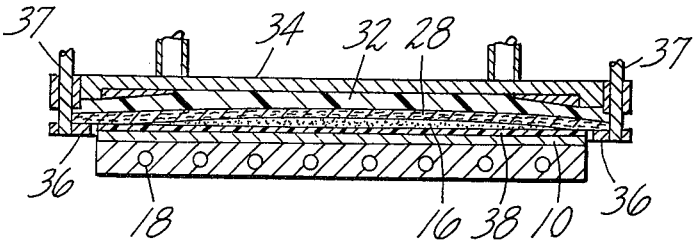
FIG. 3 is a view of an arrangement for pressing a resin layer against a clamped workpiece as a further step in the method of the present invention.

It appears that the separability of the resin layer from the transfer surface member results primarily from crystallization of the resin substantially only at the interface of the resin with the transfer surface member. Thus directly after the separation, the resin layer is very soft and deformable to the extent that light finger pressure on the surface which was separated from the transfer surface member will form finger shaped depressions indicating that the crystallized surface is very thin and that the resin beneath that surface remains a viscous liquid. This is of particular advantage since even where the applied resin layer is very thin as at 26 in FIG. 2, the resin not directly in contact with the transfer surface member remains liquid for wetting adhesive engagement with the surface of the shoe part. Also as shown in FIG. 3 edge portions may be thinned by localized pressure on edge portions to cause the still fluid resin to flow away from the edge portions to give a desired reduction in thickness down to the resin directly in contact with the transfer surface member.

Prior to lasting or otherwise shaping, the portion of the shoe upper carrying the resin layer is preferably softened by heat as by steaming which also offers the advantage of rendering upper materials such as leather more readily lastable. While in softened condition, the shoe upper is formed over the last and the layer of resin is found to conform smoothly. After removal from the last, the toe portion of the shoe exhibits superior stiffness.

The following Examples are given by way of illustration to aid in understanding the invention more clearly but it is to be understood that the invention is not restricted to the particular materials or procedures of the Examples.

EXAMPLE 1

A copolyester was formed by condensation under conventional conditions of 1,4 butane diol with a dicarboxylic acid mixture comprising 60 mole percent terephthalic acid and 40 mole percent azelaic acid. This copolyester had a crystal melting temperature of 163° C., a temperature of incipient crystallization of 117° C., and a temperature of full crystallization of 106° C., these temperatures being determined as breaks in the endotherm or exotherm curves recorded by a differential scanning calorimeter. The resin had a falling ball melt viscosity (⅜ inch steel ball at 215° C.) of 60 seconds.

The copolyester was supplied to a cement applying device as shown in FIGS. 1 and 2 having a thin coating of polytetrafluoroethylene on the transfer surface member. The melting chamber was maintained at a temperature of about 180° C. and the transfer surface member was at a temperature of about 35° C. The device was operated to deposit a 0.040 inch thickness layer of the molten resin on the forward part of the transfer surface member.

A leather shoe upper was disposed with its toe portion against the pad and held in place by a U-shaped clamp. The pad was then operated to press the toe portion of the upper against the layer of resin on the transfer surface member. After a time of only 3 seconds from formation of the layer of molten resin on the transfer surface member, the device was operated to separate the transfer surface member from the layer of resin which had wet and adhered to the exposed surface of the shoe upper part.

After removal of the shoe upper part from the applicator device, the part was subjected to toe steaming, mounted on a last and lasted. The resultant stiffened area of the shoe was found to have superior strength and resilient stiffness at a substantially higher value than with previous resins.

EXAMPLE 2

Pieces of foam backed vinyl resin shoe upper material were disposed in the clamp of the cement applying device and provided with an adherent resin layer 0.040 inch in thickness. After standing a week, test samples were cut (1 × 3½ inches) across the width of the material.

These samples were subjected to a stiffness test which involved placing the ends of the test samples in angled slits in spaced clamps holding the samples with a bowed configuration with the peak of the bow ⅝inch above the level of the ends of the bow. A probe was then adjusted to touch the top of the sample and was moved downwardly against the bowed section at a rate of one inch per minute. Stiffness of the stiffened material was determined as pounds per inch by dividing force value in pounds reached in pressing down on the sample by the average thickness of the sample.

Samples stiffened with the resin averaged about 14 pounds per inch.

EXAMPLE 3

A terpolyester was formed by condensation of 1,4 butane diol with a dicarboxylic acid mixture comprising 60 mole percent of terephthalic acid, 10 mole percent of isophthalic acid and 30 mole percent of azelaic acid. This terpolyester had a crystal melting point of 161° C., a temperature of incipient crystallization of 116° C. and a temperature for full crystallization of 104° C. The falling ball viscosity of the resin was 124 seconds.

The procedure of Example 1 was repeated and the stiffened shoe part was found to possess excellent strength and resilient stiffness, the stiffness being somewhat above that obtained using the resin of Example 1.

EXAMPLE 4

A terpolyester was formed by condensation of 1,4 butane diol with a dicarboxylic acid mixture comprising 54 mole percent of terephthalic acid, 16 mole percent of isophthalic acid and 30 mole percent of azelaic acid. The mixture melting temperature of resin was 150° C., the temperature of full crystallization was 85° C. The falling ball melt viscosity was 78 seconds.

The resin was supplied to an applicator device, applied to a shoe part as in Example 1. The shoe part carrying the resin layer was subjected to toe steaming, mounted on a last and lasted. The resulting toe part possesses excellent stiffness and strength.

EXAMPLE 5

A copolyesteramide was formed by condensation of 11 parts of dimerized linoleic acid ("dimer acid"), 33.5 parts of azelaic acid, 23 parts of ε caprolactone and 32.5 parts of hexamethylenediamine. This copolyesteramide had a crystal melting temperature of 156° C. and a temperature of full crystallization of 132° C.

The resin was melted and applied to the toe portion of a leather shoe upper following the procedure of Example 1. After removal of the shoe upper part from the applicator device, the part was subjected to toe steaming, mounted on a last, and lasted. The resultant stiffened toe portion of the shoe was found to have excellent strength and resilient stiffness.

EXAMPLE 6

A copolyesteramide was prepared by condensation and polymerization of 30 parts by weight of dimerized linoleic acid ("dimer acid"), 30 parts by weight of azelaic acid, 13 parts by weight of hydroquinonehydroxyethylether and 25 parts by weight of a 70% solution of hexamethylenediamine. The resulting resin had a crystal melting point of 179° C. and a crystallization temperature of 138° C.

The resin was applied to the toe portion of a shoe upper following the procedure outlined in claim 1. It was found that the transfer surface member separated readily from the layer of resin and that the resin had wet and adhered strongly to the exposed surfaces of the toe portion of the shoe.

After removal of the shoe upper from the applicator device, the toe portion was subjected to steaming, mounted on a last and lasted. The toe portion of the shoe was found to have superior strength and resilient stiffness.

EXAMPLE 7

A commercially available copolymer of ethylene and vinyl acetate understood to be formed from a mixture comprising 25% vinyl acetate and 75% ethylene was introduced into a cement applying device of which the melting chamber was maintained at 390° F. and the transfer surface member was at a temperature of about 27° C. The copolymer had a crystal melting point of 86° C., a glass transition of minus 20° C. and a crystallization temperature of about 55° C.

The resin was applied to a toe portion of a shoe following the procedure of Example One. The transfer surface member separated cleanly from the deposited resin layer within three seconds and the layer of resin was found to have wet and adhered strongly to the exposed surface of the toe portion of the shoe.

Having thus described our invention, what we claim as new and desire to secure by Letters Patent of the United States is:

1. The method for stiffening a flexible workpiece comprising the steps of depositing a layer of fast crystallizing synthetic linear polymer resin substantially free from side chains in molten condition on a transfer surface member, said transfer surface member being at a temperature controlled relative to its heat take-up capability and to the temperature and heat conductivity of the deposited molten resin rapidly to bring the deposited resin at the interface with the surface of said member to a temperature for rapid crystallization, the temperature of said transfer surface member being below the crystallization temperature of said resin but being sufficiently high to avoid supercooling of said resin, solidifying resin by crystallization from molten state at said interface of the resin with said transfer surface member leaving substantially all of the remainder of the thickness of said resin layer in soft molten condition, pressing the resin layer between said transfer surface member and the surface of said workpiece within a time after deposition of said resin on said transfer surface member during which portions of said resin layer away from said interface remain molten with a viscosity low enough for wetting adhesive engagement with and flow into conformity with the surface of said workpiece and separating said transfer surface member from said resin layer at a time when crystallized resin has formed adjacent said transfer surface member to an extent sufficient to preserve the integrity of the layer of resin during separation.

2. The method for stiffening a flexible workpiece as defined in claim 1 in which said resin is a work-orientable resin having a crystallization rate at optimum crystallization temperature of not more than about 4 seconds and said pressing step causes flow of said resin to assist orientation of the molecules of the resin and speed up crystallization.

3. The method for stiffening a flexible workpiece as defined in claim 2, in which the heat take-up capability of said transfer surface member is reduced by a coating, film or sheet of resinous release material.

4. The method for stiffening a flexible workpiece as defined in claim 2 in which said transfer surface member has a surface temperature to bring resin at said interface to a temperature resulting from heat transfer from resin of the molten layer to resin at said interface on the one hand and heat transfer from resin at said interface to said transfer surface member on the other hand approximating optimum crystallization temperature, in which substantially only the resin adjacent said transfer surface member has crystallized when pressing is begun and in which said pressing causes flow of molten resin to form, after pressing, an edge portion thinner than central portions of the resin layer.

5. The method for stiffening a flexible workpiece as defined in claim 2 in which said resin is a polyester resin, polyesteramide resin, or mixture of these, having a crystallization temperature of from about 80° C. to about 165° C.

6. The method for stiffening a flexible workpiece as defined in claim 5 in which said workpiece is a toe portion of a shoe, said layer of resin has a thickness of from about 0.010 to about 0.050 inch and said transfer surface member has an outline corresponding at least in part to the desired outline of the area to be stiffened of said toe portion.

7. The method for stiffening the toe portion of a shoe as defined in claim 6 in which the acid component for forming said polyester or polyesteramide is a mixture of aromatic and aliphatic dicarboxylic acids.

8. The method for stiffening the toe portion of a shoe as defined in claim 7 in which said acid components are a mixture of from about 60 to about 80 mole percent of terephthalic acid, from 0 to 15 mole percent of isophthalic acid and from 40 to 5 mole percent of a substantially saturated aliphatic dicarboxylic acid having from 4 to 36 carbon atoms.

9. The method for stiffening the toe portion of a shoe as defined in claim 8 in which said resin is at a temperature of from about 175° C. tc about 215° C. when applied to said transfer surface member, said transfer surface member is at a temperature of from about 30° C. to about 50° C. and said transfer surface member is separated from said resin layer within about four seconds after application of said resin to said transfer surface member.

10. The method for stiffening the toe portion of a shoe as defined in claim 9 in which the heat take-up capability of said transfer surface member is reduced by a coating, film or sheet of resinous release material, and in which substantially only the resin adjacent said transfer surface member has crystallized when pressing is begun and said pressing causes flow of molten resin to form, after pressing an edge portion thinner than said central portions of the resin layer.

* * * * *